US005159940A

United States Patent [19]

Hayward et al.

[11] Patent Number: 5,159,940

[45] Date of Patent: Nov. 3, 1992

[54] SMOKING ARTICLE

[75] Inventors: Charles R. Hayward; Harry V. Lanzillotti, both of Midlothian; David E. Merrill, Richmond; Edward B. Sanders, Richmond; D. Bruce Losee, Jr., Richmond; John R. Hearn, Richmond, all of Va.

[73] Assignee: Philip Morris Incorporated, New York, N.Y.

[21] Appl. No.: 222,961

[22] Filed: Jul. 22, 1988

[51] Int. Cl.[5] ..... A24D 1/60; A24D 1/02; A24D 1/12; A24D 1/18

[52] U.S. Cl. ..... 131/194; 131/195; 131/196; 131/359; 131/360; 131/361; 131/335; 131/365

[58] Field of Search ..... 131/365, 194, 369, 359, 131/198, 196, 360, 361, 335

[56] References Cited

U.S. PATENT DOCUMENTS 4,779,631 10/1988 Durocher et al. ..... 131/365
4,969,476 11/1990 Bale et al. .

FOREIGN PATENT DOCUMENTS 0174645 3/1986 European Pat. Off. ..... 131/194

*Primary Examiner*—V. Millin
*Attorney, Agent, or Firm*—Glenn A. Ousterhout

[57] ABSTRACT

A smoking article in which a flavored aerosol is generated by heat transfer to a flavor bed from the combustion of a carbon heat source is provided wherein the carbon heat source and the flavor bed are contained within a non-combustible substantially cylindrical hollow ceramic sleeve. The article generates substantially no sidestream smoke. The transfer of heat from the heat source is accomplished by convective and radiative heat transfer.

40 Claims, 11 Drawing Sheets

SMOKING ARTICLE

BACKGROUND OF THE INVENTION

This invention relates to smoking articles which produce substantially no visible sidestream smoke. More particularly, this invention relates to a smoking article in which the sensations associated with the smoking of tobacco are achieved without the burning of tobacco. This invention further relates to such a smoking article utilizing a non-combustible sleeve of a porous ceramic material wherein said ceramic sleeve is used for holding a heat source and a flavored aerosol releasing material.

A substantial number of previous attempts have been made to produce a smoking article which produces an aerosol or vapor for inhalation, rather than conventional tobacco smoke. For example, Siegel U.S. Pat. No. 2,907,686 shows a smoking article consisting of a charcoal rod and a separate carrier impregnated with flavorants and a synthetic "smoke" forming agent which is heated by the burning charcoal rod. The charcoal rod is coated with a concentrated sugar solution so as to form an impervious layer during burning. It was thought that this layer would contain the gases formed during smoking and concentrate the heat thus formed.

Another smoking article, shown in Ellis et al. U.S. Pat. No. 3,258,015, employs burning tobacco in the form of a conventional cigarette to heat a metallic cylinder containing a source of nicotine, such as reconstituted tobacco or tobacco extract. During smoking, the vapors released from the material inside the metal tube mix with air inhaled through an open end of the tube which runs to the burning end of the smoking article. Ellis et al. U.S. Pat. No. 3,356,094 shows a similar smoking article in which the tube becomes frangible upon heating, so that it would break off and not protrude when the surrounding tobacco has burned away.

Published European patent application 0 177 355 by Hearn et al. shows a smoking article which produces a nicotine containing aerosol by heating, but not burning, a flavor generator. The flavor generator could be fabricated from a substrate material such as alumina, natural clays and the like, or tobacco filler. The flavor generator is impregnated with thermally releasable flavorants, including nicotine, glycerol, menthol and the like. Heating of the flavor generator is provided by hot gases formed as a result of the combustion of a fuel rod of pyrolized tobacco or other carbonaceous material.

Banerjee et al. U.S. Pat. No. 4,714,082 shows a variation of the Hearn et al. article which employs a short fuel element. The performance of the device is said to be improved by maximizing heat transfer between the fuel element and the aerosol generator. This is effected by preventing heat loss by insulation, and by enhancing heat transfer between the burning fuel and the flavor generator by a metallic conductor. A spun glass fiber insulator surrounds the fuel element and aerosol generator assembly.

The Banerjee et al. device suffers from a number of drawbacks. First, the resilient glass fiber insulating jacket is difficult to handle on modern mass production machinery. Second, the glass fibers may become dislodged during shipping and may migrate through the pack to rest on the mouth end of the article, giving rise to the potential for inhalation of glass fibers into the smoker's mouth. Additionally, the use of a metallic heat conductor may be somewhat inefficient because the conductor itself absorbs much of the heat produced by the fuel element.

It would be desirable to be able to provide a smoking article in which a flavored aerosol releasing material is efficiently heated by hot gases formed by the passage of air over, and by radiation from, a carbonaceous heat source.

It also would be desirable to avoid the potential for inhalation of glass fibers by a smoker of such an article.

It further would be desirable to provide such an article which has both the look and feel of a conventional cigarette.

It still further would be desirable to provide a non-combustible sleeve of a lightweight and porous ceramic material for use in such an article wherein said sleeve is used to contain a heat source and a flavored aerosol releasing material.

SUMMARY OF THE INVENTION

It is an object of this invention to provide a smoking article in which a flavored aerosol releasing material is efficiently heated by a carbonaceous heat source.

It also is an object of this invention to avoid the potential for inhalation of glass fibers by a smoker of such an article.

It is a further object of this invention to provide such an article which has both the look and feel of a conventional cigarette.

It is a still further object of this invention to provide a non-combustible sleeve of a lightweight and porous ceramic material for use in such an article wherein said sleeve contains a carbonaceous heat source and a flavored aerosol releasing material.

In accordance with this invention, there is provided a smoking article having a mouth end and a distal end remote from the mouth end. The smoking article includes an active element at the distal end in fluid communication with the mouth end and may include a filter adjacent the mouth end. The active element includes a non-combustible substantially cylindrical hollow sleeve of a porous ceramic material having internal and external walls, and having a first end at the distal end and a second end closer to the mouth end. A substantially cylindrical carbon-containing heat source is inserted in the sleeve adjacent the first end of the sleeve. Preferably, the heat source is suspended in the sleeve adjacent the first end and spaced from the interior wall of the sleeve, thereby defining an annular space around the heat source. The heat source has a multi-sided fluid passage substantially through the center thereof. A flavored aerosol releasing bed is provided in the sleeve adjacent the second end thereof, in radiative and convective heat transfer relationship with the heat source. The porous ceramic sleeve may be air-permeable adjacent the heat source for admitting air to support combustion of the heat source, and may be made air-impermeable adjacent the flavor bed by a separate inner or outer lining or by blocking the pores by glazing or other treatment if desired. When the heat source is ignited and air is drawn through the smoking article, air is heated as it passes through the fluid passage. The heated air flows through the flavor bed, releasing the flavored aerosol, and carrying the flavored aerosol to the mouth end.

BRIEF DESCRIPTION OF THE DRAWINGS

The above and other objects and advantages of the invention will be apparent upon consideration of the following detailed description, taken in conjunction with the accompanying drawings, in which like reference characters refer to like parts throughout, and in which.

DETAILED DESCRIPTION OF THE INVENTION

Figure 1:
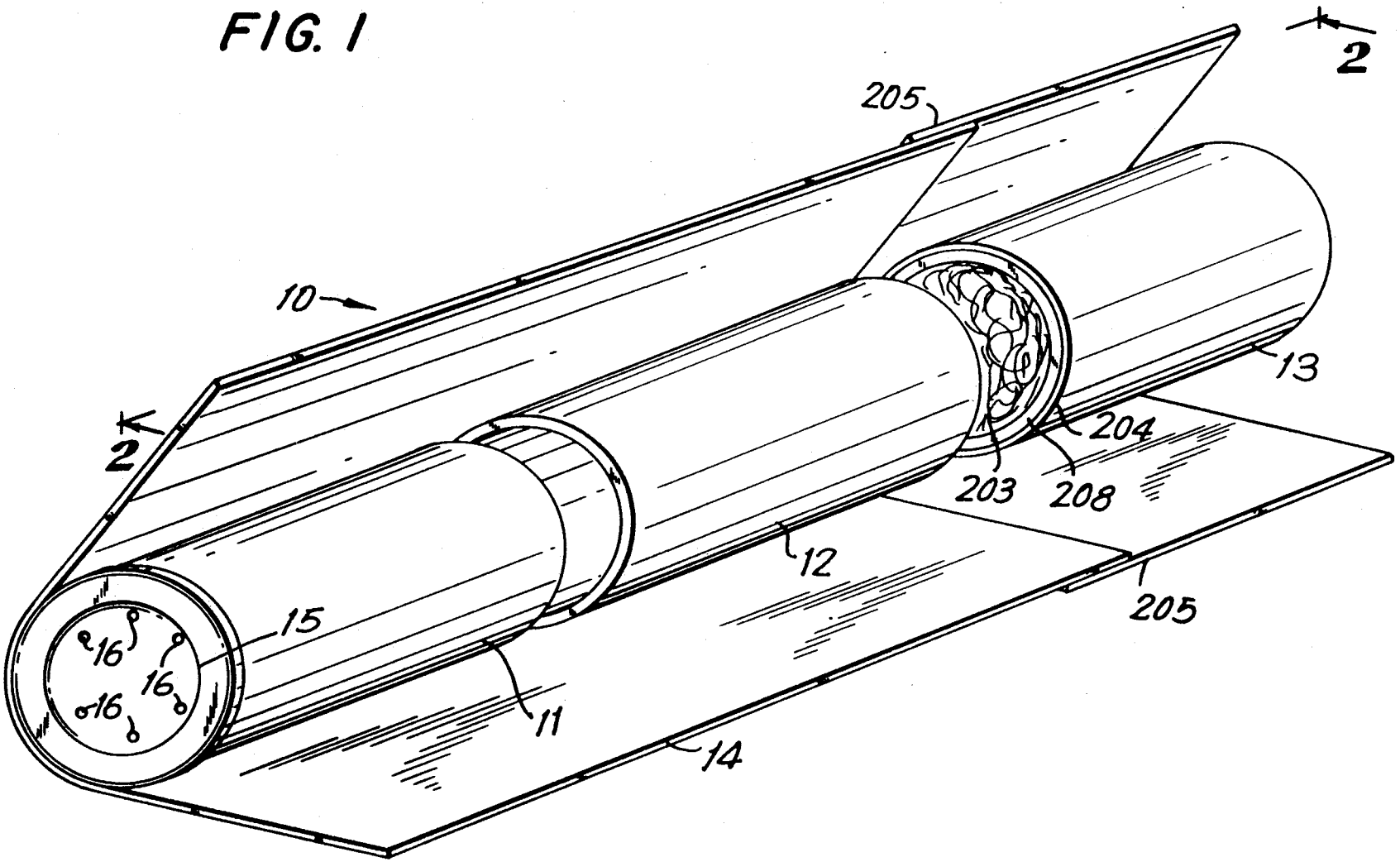
FIG. 1 is an exploded perspective view of a first preferred embodiment of a smoking article according to the present invention.

A preferred embodiment of a smoking article according to the present invention is shown in FIGS. 1-6 and 14. Smoking article 10 consists of an active element 11, a spacer tube 12, and a mouthpiece element 13, overwrapped by cigarette wrapping paper 14. As discussed in more detail below, active element 11 includes a non-combustible substantially cylindrical hollow ceramic sleeve 22, carbon heat source 20 and a flavor bed 21 which releases a flavored aerosol when contacted by hot gases flowing through the heat source. The aerosol passes through expansion chamber tube 12 to mouthpiece element 13, and thence to the mouth of a smoker.

As explained in more detail in copending U.S. patent application Ser. No. 223,232 filed concurrently herewith and hereby incorporated by reference in its entirety, carbon heat source 20 is substantially pure carbon with some catalysts or burn additives. Carbon heat source 20 preferably is formed from charcoal and has one or more longitudinal passageways therethrough. These longitudinal passageways preferably are in the shape of multi-pointed stars having long narrow points. Carbon heat source 20 has a void volume greater than about 50% with a pore size between the charcoal particles of about one to about 2 microns. Carbon heat source 20 has a weight of about 81 mg/10 mm and a density between about 0.2 g/cc and about 1.5 g/cc. The BET surface area of the charcoal particles used in carbon heat source 20 is in the range of about 50 $m^2/g$ to about 2000 $m^2/g$.

Flavor bed 21 can include any material that releases desirable flavors and other compounds when contacted with hot gases. In a smoking article, the flavors and other compounds may be those associated with tobacco, as well as other desirable flavors. Thus, suitable materials for flavor bed 21 may include tobacco filler or an inert substance on which desirable compounds have been deposited. In a preferred embodiment, described in detail in copending U.S. patent application Ser. No. 222,831, filed concurrently herewith and hereby incorporated by reference in its entirety, flavor bed 21 is a packed bed of pelletized tobacco. The pellets are preferably formed by combining in an extruder particularized tobacco materials having a size of from about 20 mesh to about 400 mesh, preferably about 150 mesh, an aerosol precursor, for example, glycerine, 1,3-butanediol or propylene glycol, that can be widely dispersed among the tobacco particles, and a finely divided filler material, for example, calcium carbonate or alumina, to increase the thermal load to prevent the hot gases from raising the temperature of the pellets above their thermal decomposition temperature. The materials are mixed to form a mixture, and the mixture is extruded out a die typically having a plurality of orifices into spaghetti-like strands of about the same diameter. The extruded strands are cut into lengths, preferably of uniform length. The pellets preferably are uniformly dimensioned and comprise a mixture of about 15% to about 95% tobacco material, about 5% to about 35% aerosol precursor, and about 0% to about 50% filler material.

Given sufficient oxygen, heat source 20 will burn to produce mostly carbon dioxide. As discussed below, sleeve 22 of active element 11 is non-combustible, and does not burn during smoking of article 10. Further, article 10 is constructed in such a way that the gases flowing through flavor bed 21 have a reduced oxygen content so that the constituents of flavor bed 21 undergo pyrolysis and not combustion even if their temperature is high enough to ignite them otherwise. There is substantially no sidestream smoke when article 10 is smoked.

Turning to the details of the construction of article 10, active element 11 is housed in a non-combustible substantially cylindrical hollow ceramic sleeve 22 having an external wall 23 and an internal wall 24. Preferably, however, sleeve 22 may be fitted with one or more metallic clips 17 which hold carbon heat source 20 suspended away from internal wall 24 of sleeve 22, leaving an annular space 25. Clip 17 may have openings 18, which make clip 17 more flexible, allowing for easier assembly of active element 11. Clip 17 must be wide enough so that heat source 20 can be held securely in place. The area of contact between clip 17 and heat source 20 is also large enough so that when heat source 20 burns back to clip 17, heat source 20 will be extinguished. Therefore, heat source 20 will not ignite the remainder of article 10.

Figure 5:
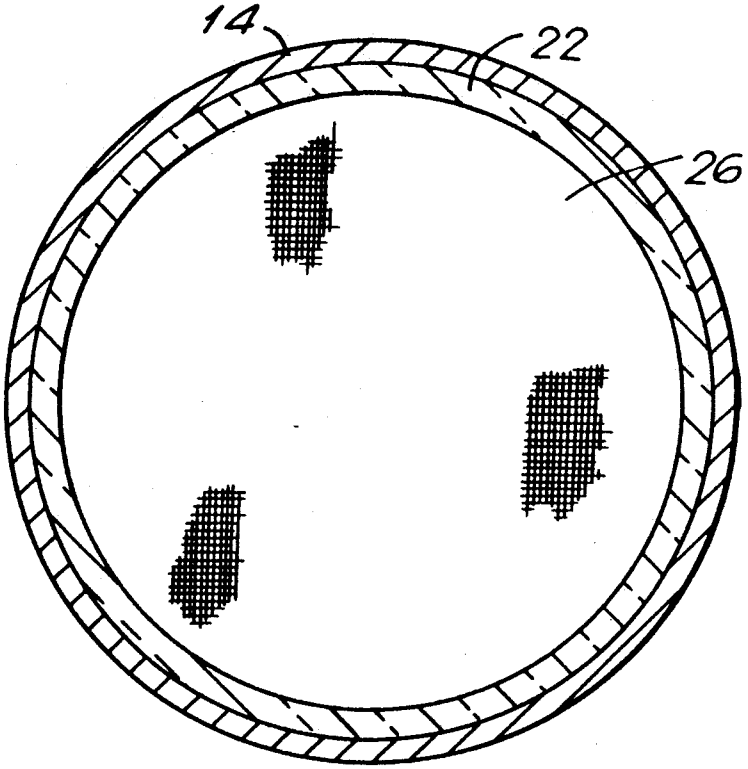
FIG. 5 is a radial cross-sectional view of the smoking article of FIGS. 1-4, taken from line 5—5 of FIG. 2.

Flavor bed 21 is held within sleeve 22 between clip 17 and heat source 20 on one end, and a perforated or screen-like clip 26, which holds in the pellets of bed 21 while allowing the hot vapors to pass through into expansion chamber tube 12, on the other end. A perforated clip 26, as shown in FIG. 5, is preferred. Expansion chamber tube 12 gives article 10 the length, and thus the appearance, of an ordinary cigarette.

Cigarette wrapping paper 14 holds active element 11 and expansion chamber tube 12 together. Cigarette wrapping paper 14 is preferably a paper treated to minimize thermal degradation, such as a magnesium oxide cigarette paper, or other suitable refractory type cigarette paper. Preferably, cigarette wrapping paper 14 will have sufficient porosity to allow air to be admitted through paper 14 and sleeve 22 to support combustion of heat source 20. Alternatively, paper 14 may be perforated, such as by laser perforation, in the region of sleeve 22 which surrounds heat source 20.

Preferably, a disk 27 closes off the mouth end of active element 11, leaving only an orifice 28 for the passage of the hot vapors. Passage through orifice 28 causes the hot vapors to expand into expansion chamber tube 12. Expansion of the gases into the expansion chamber causes cooling of the saturated vapors to form the aerosol, thereby minimizing condensation on mouthpiece element 13 or segments 29, 30 of mouthpiece element 13, thus increasing the delivery of aerosol to the smoker. The degree of expansion, and therefore of cooling, may be controlled by varying the size of orifice 28 and the volume of expansion chamber 12.

Mouthpiece element 13 may be a hollow tube or may include a filter segment 29. Preferably mouthpiece element 13 includes a filter segment 29 and a tobacco rod segment 30. Filter segment 29 is a cellulose acetate filter plug 201 wrapped in plug wrap 202. Tobacco rod segment 30 is tobacco filler 203, wrapped in plug wrap 208, which, in addition to further cooling the aerosol and providing some filtration, also may impart additional tobacco taste. The tobacco filler in segment 30 is preferably cut at the standard 30 cuts per inch, but may be coarser to minimize filtration. For example, the tobacco filler may be cut at about 15 cuts per inch. The two segments 29, 30 of filter element 13 are jointly overwrapped by plug wrap 204, and the entire filter element 13 is attached to the remainder of article 10 by tipping 205.

Returning to the structure of active element 11, in the embodiment illustrated in FIGS. 2–6, annular space 25 is provided so that there is sufficient air flow to heat source 20 to allow for sustained combustion of heat source 20, and so that conduction of heat to the outside is minimized. For the same reason, sleeve 22 is made of a porous ceramic material and preferably has a porosity of at least about 40%. The porous ceramic sleeve may be air-permeable adjacent heat source 20 for admitting air to support the sustained combustion of heat source 20. Paper 14 should have sufficient porosity or perforations to also allow for admitting air through paper 14 and sleeve 22 to support the sustained combustion of heat source 20. The air flow in element 11 into flavor bed 21 is through fluid passage 206 in heat source 20 and around air space 25 through openings 18.

It is desirable that as large as possible a surface area of heat source 20 be in contact with the airflow to maximize the convective heat transfer to flavor bed 21, and permit combustion to be as complete as possible. For that same reason, fluid passage 206 is not a simple cylindrical passage. Rather, fluid passage 206 in heat source 20 has a many-sided cross-section, such as the eight-pointed star cross-section shown in the FIGURES. In fact, the surface area of fluid passage 206 in the preferred embodiment is greater than the surface area of the outer surface of heat source 20.

Sleeve 22 is made from a ceramic material, preferably a porous ceramic material. Sleeve 22 may be fabricated using conventional ceramic processing methods, adjusted so that the resultant ceramic sleeve 22 has the desired balance of properties. The ceramic material used is non-combustible. The ceramic material used should be inexpensive, lightweight and porous and should still have sufficient strength when fabricated as sleeve 22 to withstand crushing loads and other forces applied during high speed assembly operations on modern mass production machinery. These characteristics are related to the particular ceramic material used, its porosity, density and pore size. Thus, after fabrication, ceramic sleeve 22 should have a density of between about 1.1 g/cc and about 2.0 g/cc, and a porosity of between about 40% and about 60%. The particle size of the ceramic material used is between about 0.5 microns and about 100 microns. Preferably, the ceramic sleeve will have a density of about 1.3 g/cc and a porosity of about 50%, and the ceramic material used will have a particle size of about 35 microns. Any ceramic material having the foregoing balance of properties may be used, provided that sleeve 22 has adequate strength properties in order to withstand, without excessive breakage, the impacts and forces encountered in assembling the smoking article on modern mass production machinery. One preferred ceramic material is cordierite, which is a known ceramic material comprising magnesium, silicon and aluminum. In addition to cordierite, other suitable ceramic materials include mullite, alumina and zirconia.

Figure 2:
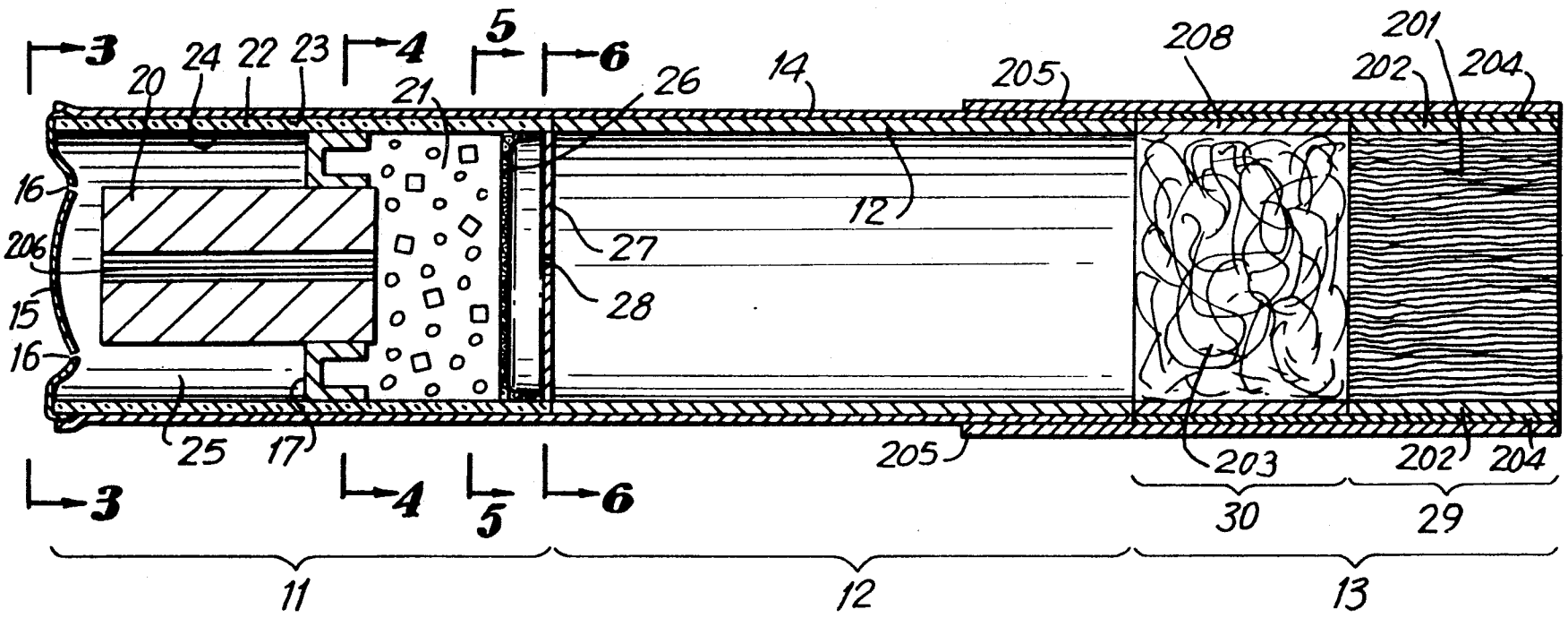
FIG. 2 is a longitudinal cross-sectional view of the smoking article of FIG. 1, taken from line 2—2 of FIG. 1.
Figure 4:
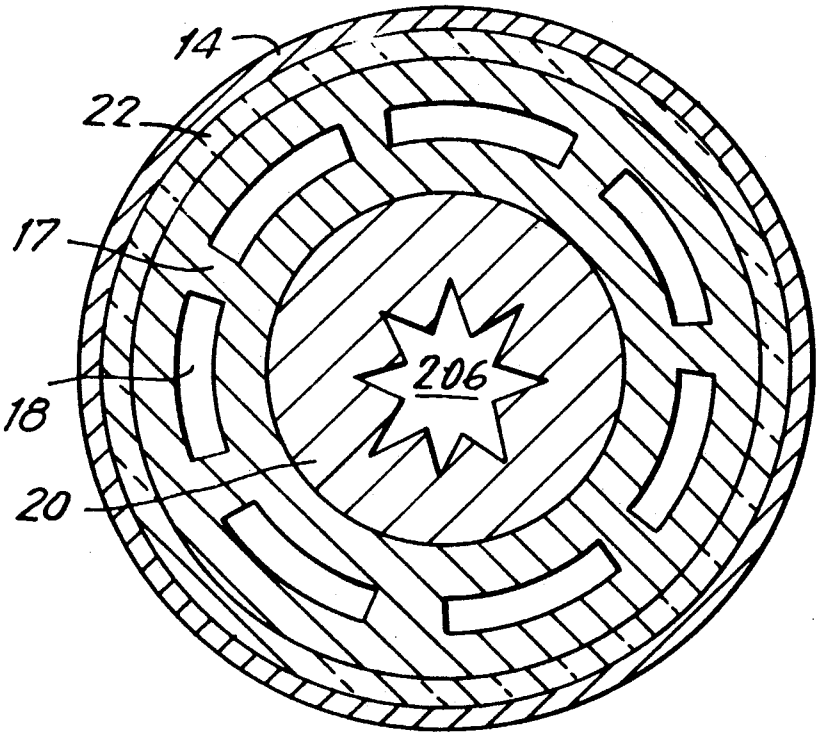
FIG. 4 is a radial cross-sectional view of the smoking article of FIGS. 1-3, taken from line 4—4 of FIG. 2.
Figure 3:
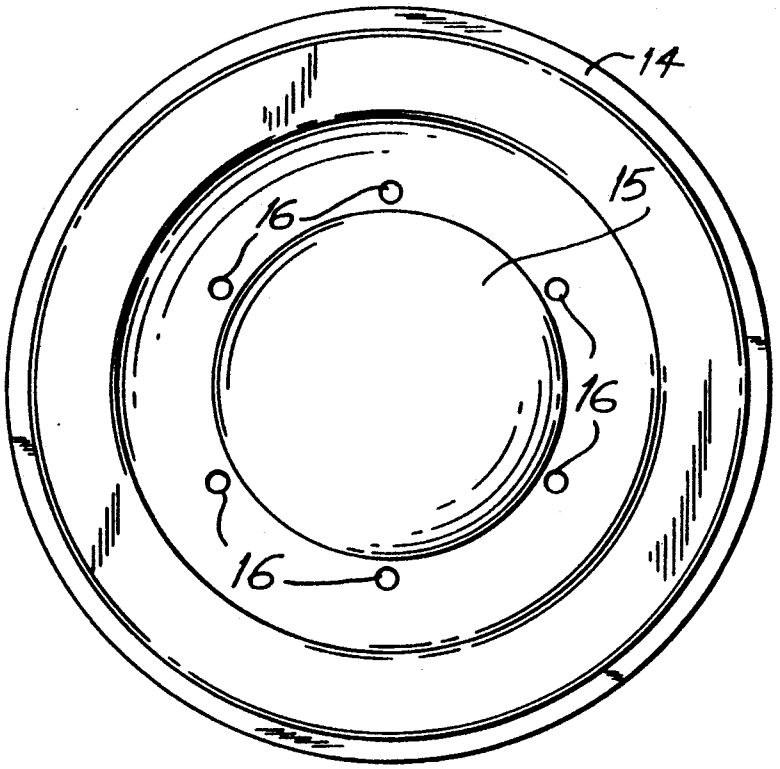
FIG. 3 is an end view of the smoking article of FIGS. 1 and 2, taken from line 3—3 of FIG. 2.
Figure 6:
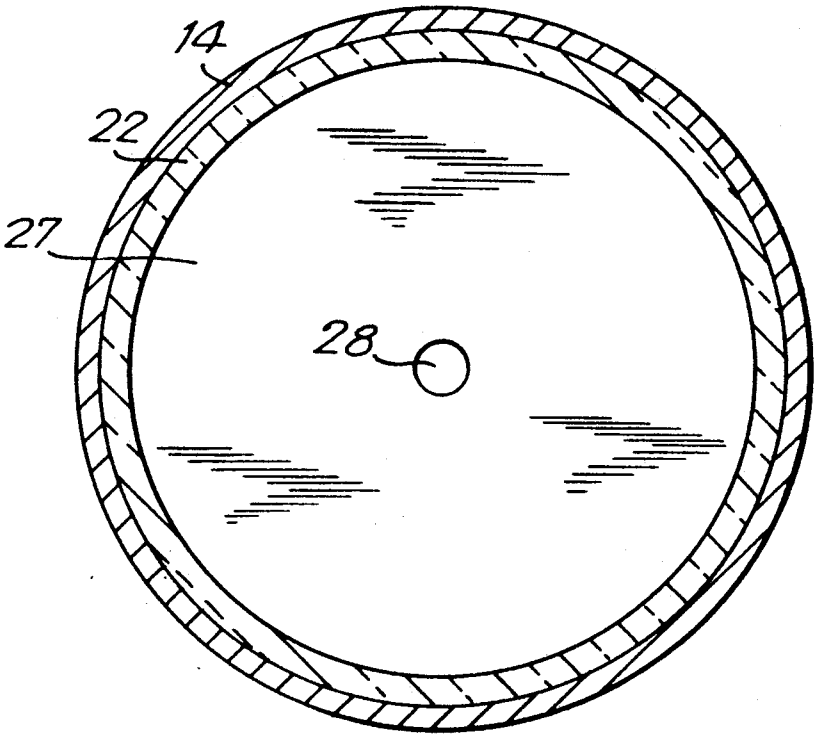
FIG. 6 is a radial cross-sectional view of the smoking article of FIGS. 1-5, taken from line 6—6 of FIG. 2.

Finally, as shown in FIGS. 1–3, active element 11 may be provided with a reflective metallic end cap 15 which clips over the external wall 23 of sleeve 22 but is covered by wrapper 14. Cap 15 has one or more openings 16 which allow air into active element 11. Openings 16 preferably are located at the periphery of cap 15. In the preferred embodiment, there are six equiangularly spaced openings each having a diameter of 0.080 in. Cap 15 increases the reflection of radiation back into active element 11, to aid in maintaining combustion of heat source 20 and to aid in the release of flavor from bed 21. Cap 15 also keeps heat source 20 from falling out of article 10 if it somehow becomes loose. This is important when it is considered that heat source 20 smolders at a high temperature between puffs and is even hotter during puffs. In addition, cap 15 keeps in any ash that may form during burning of heat source 20. Alternatively, cap 15 may be made from a porous ceramic material, such as the ceramic material used in sleeve 22.

It is preferred that article 10 have an outer diameter of 7.8 mm, similar to a conventional cigarette. Carbon heat source 20 has a diameter of 4.6 mm and a length of 10 mm, while active element 11 has an overall length of 26 mm. Mouthpiece element 13 has a length of 21 mm, divided between a 10 mm cellulose acetate portion 29 and an 11 mm tobacco portion 30. Spacer tube 12 is 32 mm long, so that article 10 overall is 79 mm long, which is comparable to a conventional "long-size" cigarette.

Figure 9:
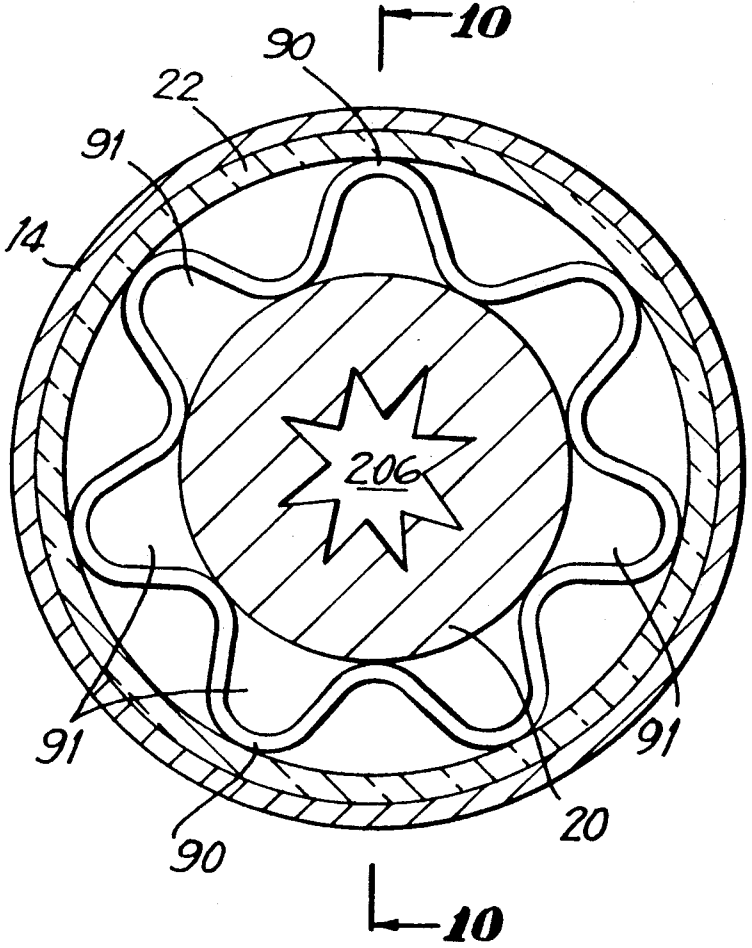
FIG. 9 is a radial cross-sectional view, similar to FIG. 4, of a third preferred embodiment of a smoking article according to this invention.
Figure 7:
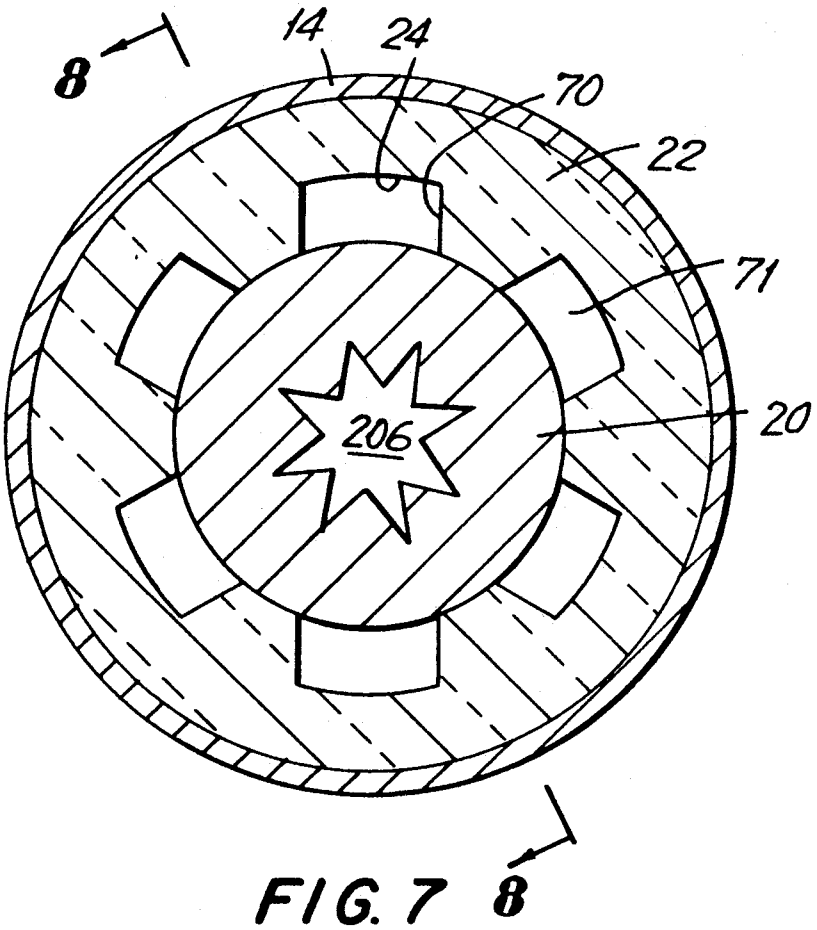
FIG. 7 is a radial cross-sectional view, similar to FIG. 4, of a second preferred embodiment of a smoking article according to this invention.
Figure 8:
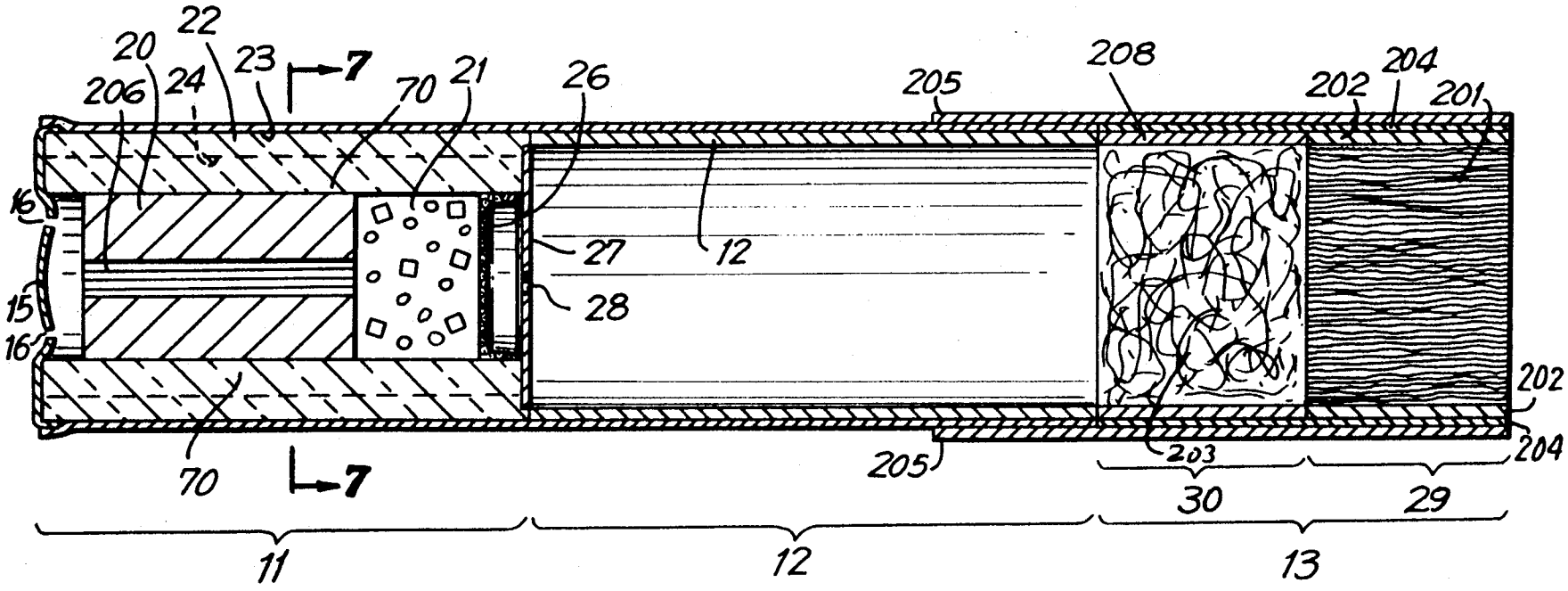
FIG. 8 is a longitudinal cross-sectional view of the smoking article of FIG. 7, taken from 8—8 of FIG. 7.
Figure 10:
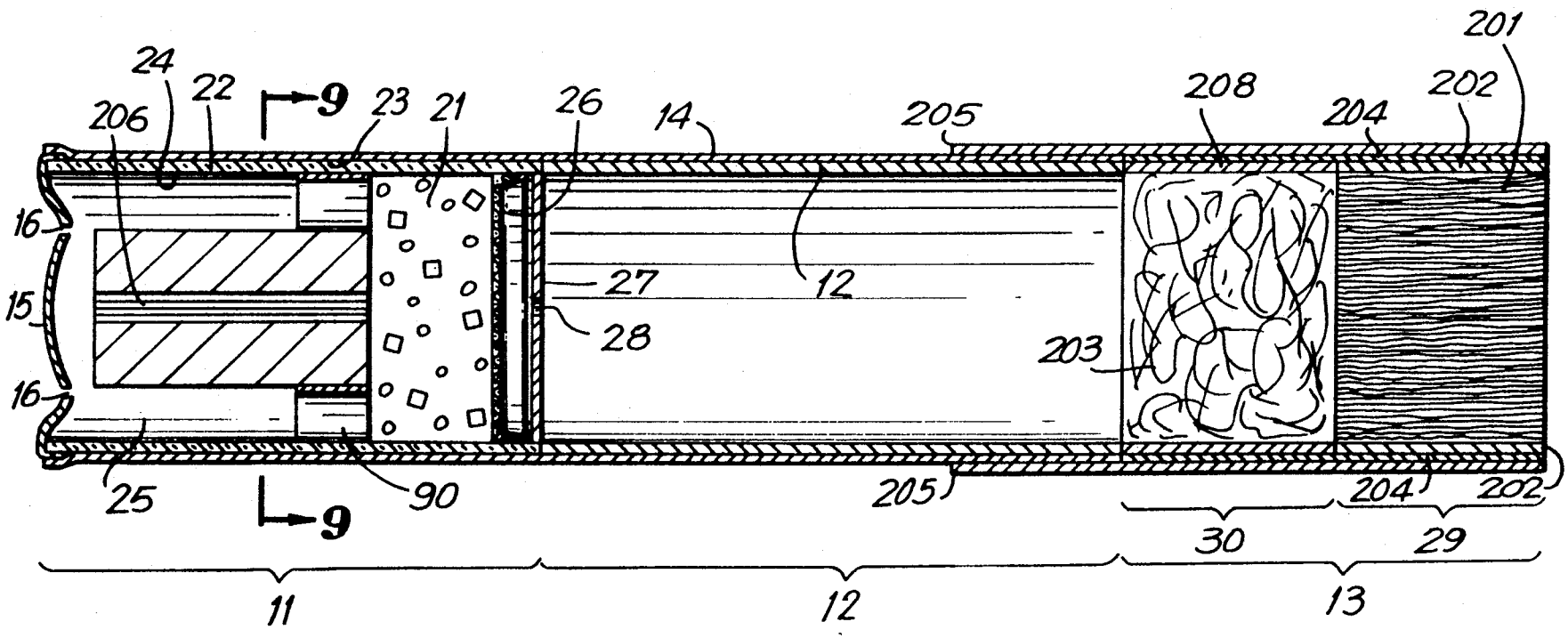
FIG. 10 is a longitudinal cross-sectional view of the smoking article of FIG. 9, taken from line 10—10 of FIG. 9.
Figure 11:
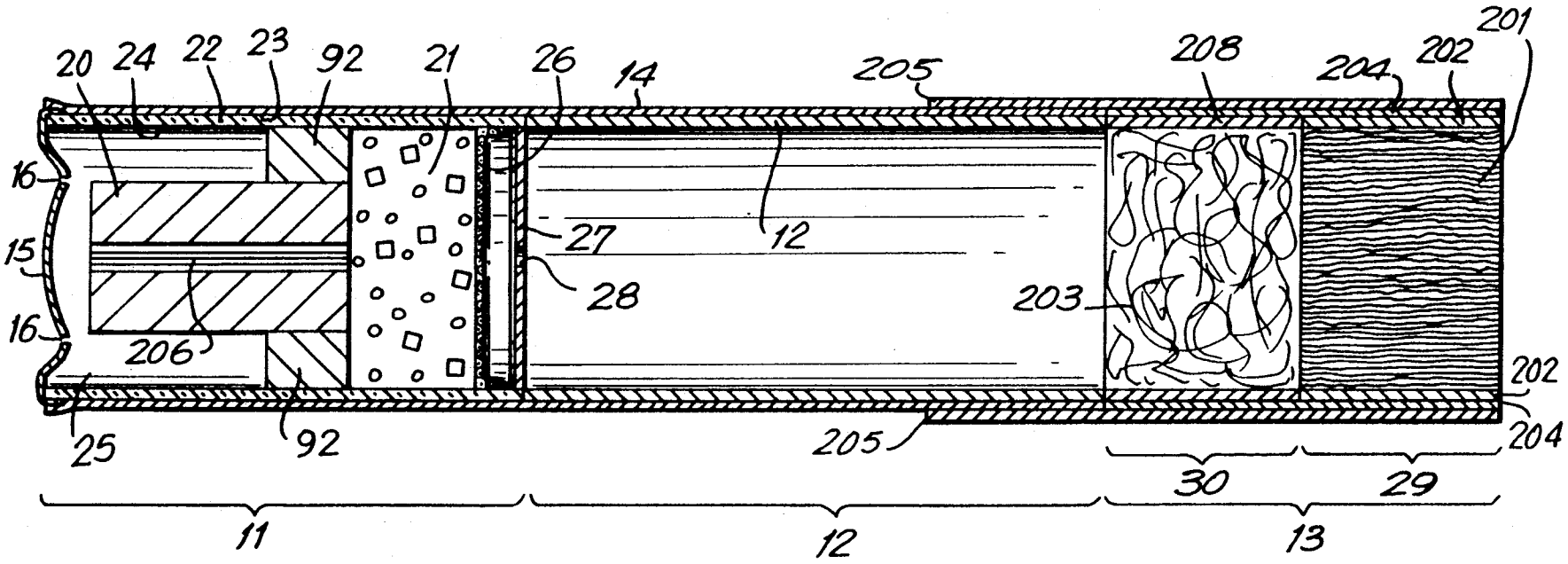
FIG. 11 is a longitudinal cross-sectional view, similar to FIG. 2, of a fourth preferred embodiment of a smoking article according to this invention.
Figure 12:
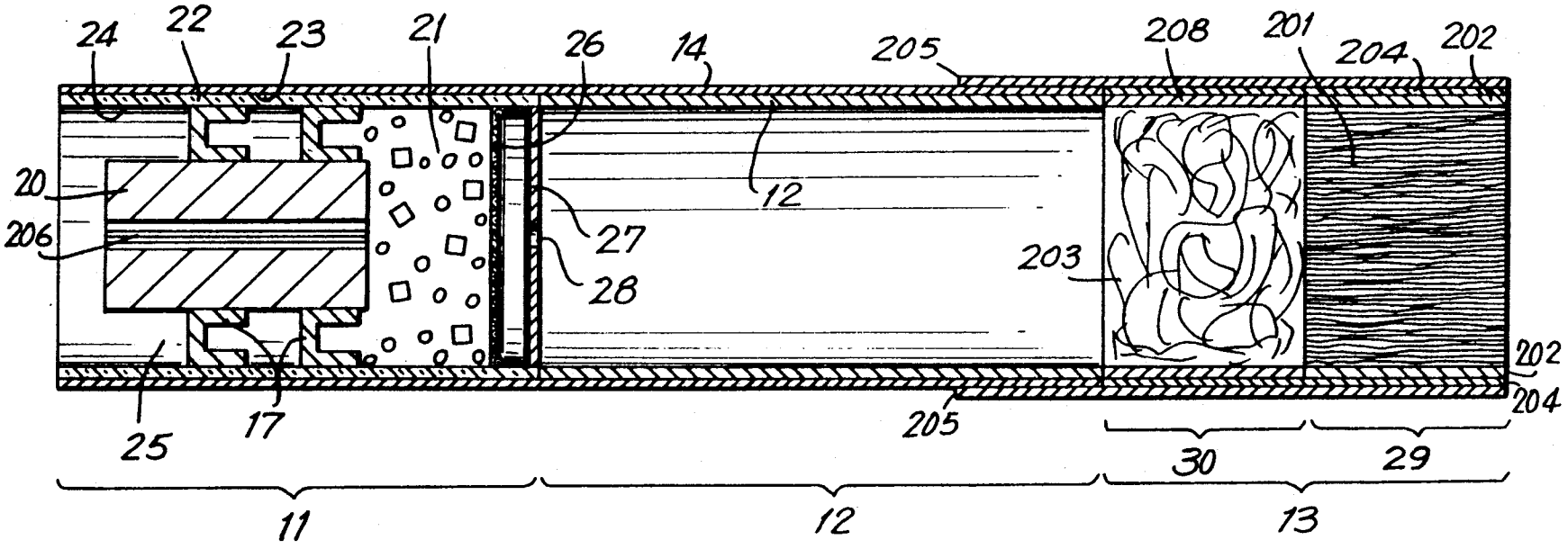
FIG. 12 is a longitudinal cross-sectional view, similar to FIG. 2, of a fifth preferred embodiment of a smoking article according to this invention.

Alternative embodiments are shown in FIGS. 7–13. In FIGS. 7 and 8, heat source 20 of article 80 is instead held in place by ridges 70 provided on internal wall 24 of sleeve 22. Ridges 70 hold carbon heat source 20 suspended away from internal wall 24, leaving an annular space 25. Ridges 70 are separated by slots 71 to allow for air flow. In FIGS. 9 and 10, a corrugated paper band 90, allowing air flow through its corrugations 91, holds heat source 20 in sleeve 22. In FIG. 11, a solid paper collar 92 holds heat source 20 in sleeve 22. Paper collars preferably have a thin layer of metallic foil over their internal surface in contact with heat source 20 to protect the paper collars from the heat generated by heat source 20. In FIG. 12, sleeve 22 is shown fitted with two metallic clips 17 to hold carbon heat source 20 suspended away from the internal wall 24 of sleeve 22, leaving annular space 25. Both clips 17 may have openings 18 to allow for air flow. The embodiment illustrated in FIG. 12 is shown without end cap 15. An end cap 15, as shown in FIGS. 1-3 or as described above, could be added to this embodiment if desired.

Figure 13:
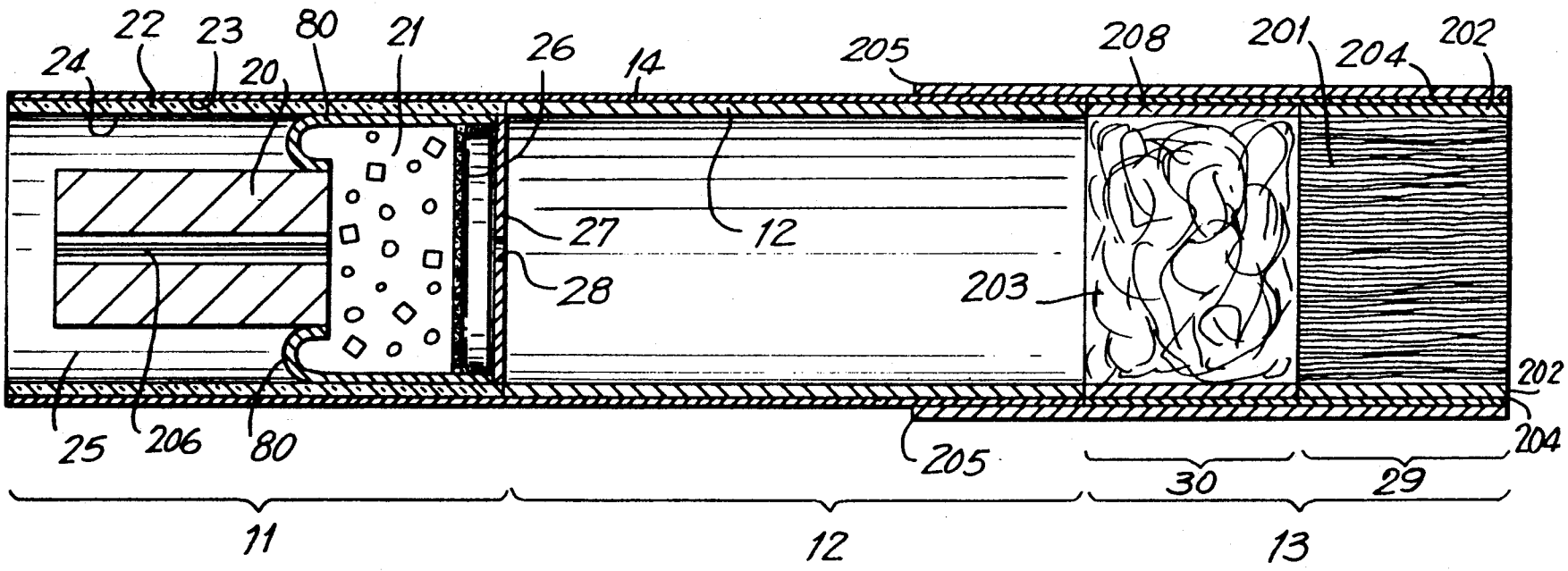
FIG. 13 is a longitudinal cross-sectional view, similar to FIG. 2, of a sixth preferred embodiment of a smoking article according to this invention.
Figure 14:
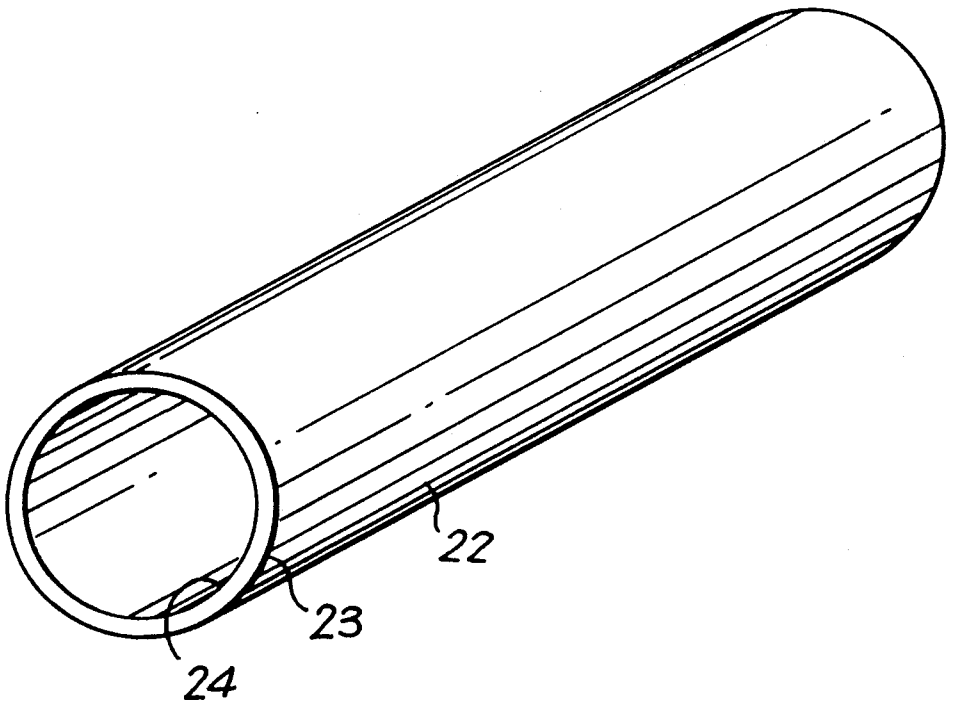
FIG. 14 is a perspective view of a preferred embodiment of a substantially cylindrical hollow ceramic sleeve for a smoking article according to the present invention, such as those shown in FIGS. 1-6 and 9-13.

A further preferred embodiment of a smoking article according to the present invention is shown in FIG. 13. In FIG. 13, a paper tube 80 holds heat source 20 in sleeve 22 and also holds flavor bed 21. The end of tube 80 adjacent to heat source 20 is turned down, as shown in FIG. 13, in order to hold heat source 20. Paper tube 80 is preferably made from paper coated on one or both sides with aluminum foil or other reflective material.

As noted above, article 10 is constructed in such a way that the gases flowing through flavor bed 21 have a reduced oxygen content so that the constituents of flavor bed 21 do not oxidize or combust even if their temperature is high enough to ignite them otherwise. In all of the foregoing embodiments, it is possible to provide a means to still further keep air out of flavor bed 21 and to still further prevent combustion of flavor bed 21. For example, external wall 23 of sleeve 22 could be overwrapped in the region of flavor bed 21 by a layer of an air-impermeable material such as paper (not shown). Alternatively, internal wall 24 of sleeve 22 could be lined in the region of flavor bed 21 by an air-impermeable material such as a metallic foil (not shown).

A further preferred embodiment of a smoking article according to the present invention is to insert in ceramic sleeve 22, an active element as described in detail in copending U.S. patent application Ser. No. 223,153, filed concurrently herewith and hereby incorporated by reference in its entirety.

EXAMPLE 1

Smoking articles were constructed using a 14 mm long carbon heat source 20 containing an eight point star-shaped fluid passage 206 in the center of it. The heat source 20 was suspended in a 14 mm long ceramic sleeve 22 made of cordierite of 1.35 g/cc density using a solid paper collar 92 that had an axial length of 3 mm. Flavor bed 21 consisted of 100 mg of pelletized tobacco contained in a paper tube. Flavor bed 21 and ceramic sleeve 22 were connected with paper and were then connected with a 39 mm hollow expansion chamber tube 12 and a 15 mm long cellulose acetate filter segment 29. When smoked under FTC conditions,* two of these smoking articles averaged a wet TPM (total particulate matter) of 4.7 mg.

* FTC smoking conditions consist of two seconds of puffing (35 ml total volume) separated by 58 seconds of smolder.

EXAMPLE 2

Smoking articles were assembled using 25 mm long ceramic sleeves 22 made of cordierite of 1.35 g/cc density. A 10 mm long carbon heat source 20 was suspended inside the sleeve 22 with a metallic clip 17. Toward the mouth end of the sleeve, a paper/foil tube was inserted and the paper/foil tube was filled with 100 mg of pelletized tobacco which was held in place with two perforated aluminum clips 26. This active element 11 was inserted into a holder. FTC smoking results on 50 such articles averaged 8.2 mg wet TPM (standard deviation=0.21) and 0.29 mg nicotine (standard deviation=0.14).

Thus, it is seen that a smoking article in which a flavored aerosol releasing material is efficiently heated by a carbonaceous heat source, which avoids the potential for inhalation of glass fibers by the smoker, and which has both the look and feel of a conventional cigarette is provided. One skilled in the art will appreciate that the present invention can be practiced by other than the described embodiments, which are presented for purposes of illustration and not of limitation, and the present invention is limited only by the claims which follow.

What is claimed is:

1. A smoking article having a mouth end and a distal end remote from said mouth end, said smoking article comprising:

an active element at said distal end in fluid communication with said mouth end, said active element comprising:

a non-combustible substantially cylindrical hollow ceramic sleeve having internal and external walls, and having a first end at said distal end and a second end closer to said mouth end, a substantially cylindrical carbon-containing heat source contained in said sleeve adjacent said first end, said heat source having a fluid passage substantially through the center thereof, and a flavor bed in said sleeve adjacent said second end thereof, in direct radiative and convective heat transfer relationship with said heat source; whereby:

when said heat source is ignited and air is drawn through said smoking article, air is heated as it passes through said fluid passage, said heated air flowing through said flavor bed, releasing a flavored aerosol, and carrying it to said mouth end.

2. The smoking article of claim 1 wherein said heat source is suspended in said sleeve adjacent said first end and spaced from said interior wall of said sleeve defining an annular space around said heat source.

3. The smoking article of claim 2 wherein said ceramic sleeve is of a porous ceramic material.

4. The smoking article of claim 3 wherein said porous ceramic material comprises cordierite.

5. The smoking article of claim 3 wherein said porous ceramic material comprises mullite type ceramic of alumina and silica.

6. The smoking article of claim 3 wherein said porous ceramic material comprises alumina.

7. The smoking article of claim 3 wherein said porous ceramic material comprises zirconia.

8. The smoking article of claim 3 wherein said ceramic sleeve has a density of between about 1.1 g/cc and about 2.0 g/cc and a porosity of between about 40% and about 60%, and said porous ceramic material has a particle size of between about 0.5 microns and about 100 microns.

9. The smoking article of claim 8 wherein said density is about 1.3 g/cc, said porosity is about 50%, and said particle size is about 35 microns.

10. The smoking article of claim 2 wherein said sleeve is air-permeable adjacent said heat source for admitting air to support combustion of said heat source.

11. The smoking article of claim 10 wherein said ceramic sleeve is rendered air-impermeable adjacent said flavor bed by being overwrapped at said exterior wall adjacent said flavor bed with an air-impermeable material.

12. The smoking article of claim 11 wherein said air-impermeable material is paper.

13. The smoking article of claim 10 wherein said sleeve is rendered air-impermeable adjacent said flavor bed by being lined at said interior wall adjacent said flavor bed with an air impermeable material.

14. The smoking article of claim 13 wherein said air-impermeable material is a metallic foil for reflecting heat into said flavor bed to aid in releasing said aerosol.

15. The smoking article of claim 2 wherein said heat source is suspended in said sleeve using a metallic clip.

16. The smoking article of claim 15 wherein said metallic clip has at least one opening to allow the flow of air through said annular space.

17. The smoking article of claim 2 wherein said heat source is suspended in said sleeve by means of a paper ring.

18. The smoking article of claim 17 wherein said paper ring has at least one passage to allow the flow of air through said annular space.

19. The smoking article of claim 18 wherein said ring includes corrugations, said corrugations forming said at least one passage.

20. The smoking article of claim 2 wherein said heat source is suspended in said sleeve by means of a ridge provided on the internal wall of said sleeve.

21. The smoking article of claim 2 further comprising a perforated end cap at said distal end of said element, for preventing dropout from said element of said heat source and ash from the combustion thereof.

22. The smoking article of claim 21 wherein said end cap is reflective of radiant energy for reflecting heat back to said heat source, to aid in maintaining combustion thereof.

23. The smoking article of claim 21 wherein said end cap is of a porous ceramic material.

24. The smoking article of claim 23 wherein said ceramic material is selected from a group consisting of cordierite, mullite, aluminia or zirconia.

25. The smoking article of claim 1 further comprising a filter adjacent said mouth end.

26. The smoking article of claim 25 wherein said filter comprises a cellulose acetate filter plug adjacent said mouth end.

27. The smoking article of claim 26 further comprising a tobacco rod segment adjacent an end of said filter plug remote from said mouth end.

28. The smoking article of claim 1 wherein said heat source comprises carbon and at least one burn additive.

29. The smoking article of claim 1 wherein said flavor bed comprises tobacco.

30. The smoking article of claim 29 wherein said flavor bed comprises a plurality of tobacco-containing pellets.

31. The smoking article of claim 1 further comprising means for cooling said aerosol.

32. The smoking article of claim 31 wherein said cooling means comprises means for causing expansion of said aerosol.

33. The smoking article of claim 32 wherein said cooling means comprises an orifice at the mouth end of said active element, for passage therethrough of said aerosol, and an expansion chamber adjacent said orifice toward said filter of said smoking article.

34. A non-combustible substantially cylindrical ceramic sleeve having internal and external walls, said sleeve is of a porous ceramic material, said sleeve circumscribing at least a portion of both a fuel element and a flavor bed, for use in a smoking article.

35. The ceramic sleeve of claim 34 wherein said porous ceramic material comprises cordierite.

36. The ceramic sleeve of claim 34 wherein said porous ceramic material comprises mullite type ceramic of alumina and silica.

37. The ceramic sleeve of claim 34 wherein said porous ceramic material comprises alumina.

38. The ceramic sleeve of claim 34 wherein said porous ceramic material comprises zirconia.

39. The ceramic sleeve of claim 34 wherein said ceramic sleeve has a density of between about 1.1 g/cc and about 2.0 g/cc and a porosity of between about 40% and about 60%, and said porous ceramic material has a particle size of between about 0.5 microns and about 100 microns.

40. The ceramic sleeve of claim 39 wherein said density is about 1.3 g/cc, said porosity is about 50%, and said pore size is about 35 microns.

* * * * *